United States Patent [19]

Masubuchi et al.

[11] Patent Number: 5,000,700

[45] Date of Patent: Mar. 19, 1991

[54] INTERFACE CABLE CONNECTION

[75] Inventors: Hitoshi Masubuchi; Yasuhiro Kawatsu, both of Tokyo, Japan

[73] Assignee: Daiichi Denshi Kogyo Kabushiki Kaisha, Japan

[21] Appl. No.: 534,031

[22] Filed: Jun. 6, 1990

[30] Foreign Application Priority Data

Jun. 14, 1989 [JP] Japan ..... 1-70290

[51] Int. Cl.[5] ..... H01R 13/66

[52] U.S. Cl. ..... 439/620; 333/185

[58] Field of Search ..... 439/620; 333/181-185

*Primary Examiner*—Gary F. Paumen

*Attorney, Agent, or Firm*—Silverman, Cass & Singer, Ltd.

[57] ABSTRACT

An interface cable connection is used for connecting between electronic appliances, particularly appliances associated with a computer. The connection includes a hood covering the connector. The connection is useful for preventing accidental electric shocks, filtering undesirable electromagnetic waves and facilitating connecting interface cables.

11 Claims, 2 Drawing Sheets

INTERFACE CABLE CONNECTION

BACKGROUND OF THE INVENTION

This invention relates to a connection for an interface cable connecting between electronic appliances, particularly appliances for computers. More particularly, this invention relates to a hood for covering a connector for use in a connection of the appliances.

In general, an electronic appliance, particularly a computer has a central processor arranged at a center to which are connected a memory device, an input unit, an output unit and the like to form one system.

For example, in the computer system above described, the respective devices are connected by so-called interface cables. In most cases, each of the interface cables has a so-called interface connector at its mid-point which detachably connects two parts of the interface cable.

FIGS. 1*a* and 1*b* exemplarily illustrate such a connector which is widely used.

The connector shown in FIGS. 1*a* and 1*b* is a coaxial two-core connector having a female connector A and a male connector B. In the connectors A and B, each of the main bodies 1 and 1' is made of metal and is formed of generally cylindrical configuration. The main body 1 or 1' is provided with an insulator 2 or 2' in which are embedded contacts 3 or 3' and a cylindrical annular conductor 4 or 4'.

A forward end of each of interface cable 5 and 5' is exposed and fixed to the connector A or B by means of a cable clamp 6 or 6' made of metal and provided in the main body 1 or 1'. Center conductors 8 of coaxial cables 7 in the interface cable 5 and 5' are electrically connected to the contacts 3 and 3' directly or through lead wires, and outer conductors 9 are electrically connected to the annular conductors 4 and 4' directly or through lead wires.

Moreover, the fixed portion of the interface cable 5 or 5' is covered by a conductive braid which covers the built-in coaxial cables 7 and is turned 180° to cover a sheath of the interface cable. Since the fixed portion of the interface cable 5 or 5' is clamped to the conductive braid by means of the cable clamp 6 or 6', the conductive braid of the interface cable and the main body 1 or 1' of the connector are electrically connected to each other.

When the male connector B is moved in the direction shown by an arrow therefor in FIG. 1*a*, it is fitted in the female connector A so that a fitted condition of the connectors is obtained as shown in FIG. 1*b*. In this condition, the contacts 3 and 3' contact each other in contact recesses 2-1 of the insulator 2 of the female connector A, while the annular conductors 4 and 4' contact each other in an annular recess 2-2. A connecting nut or internal thread member 10' provided on the male connector B is threadedly engaged on screw-threads 10 formed on an outer circumference of the main body 1 of the female connector A so that the main bodies 1 and 1' of the female and male connectors A and B are electrically connected to each other.

With the development of electronic techniques, the number of electric and electronic appliances which rely upon electric power as their energy source have increased. With such an increase of appliances, various noise electromagnetic noise waves are emitted from these electric and electronic appliances to disturb their activity. For the purpose of eliminating such electromagnetic interferences, even with the usual interface connector of the prior art as shown in FIG. 1*b*, a filter such as an annular or cylindrical magnet, for example, a ferrite core 11 is fitted on the interface cable adjacent the connectors A and B as shown in FIG. 2. The filter is fixed thereat by a plastic mold 12, a thermally contractible tube or turns of plastic tape on the outer surface of the filter 11 so that undesirable electromagnetic waves are filtered to prevent them from affecting the electronic appliances.

The connectors of the prior art shown in FIGS. 1*a* and 1*b* and 2 include the metallic main bodies 1 and 1'. Therefore, when the connectors are connected or disconnected for the purpose of connecting, disconnecting or exchanging interface cables, there is often a risk of unpredictable and accidental electric shock or the like which may injure human bodies as the case may be, if high voltage is applied to the main bodies due to a thunderbolt, electric leakage or the like.

In case of a connector provided adjacent to a magnet capable of removing undesirable electromagnetic waves as shown in FIG. 2, special instruments and tools and difficult assembly operations are needed, such as injection molding of plastic coating, winding plastic tapes or heating for thermal shrinkage, in order to affix the magnet. Moreover, in cases where terminal treatment (forming of connections) of cables of predetermined lengths is effected off site in a factory, if lengths of cables are erroneously cut too short, they cannot be used and therefore are wasted.

SUMMARY OF THE INVENTION

It is an object of the invention to provide an interface cable connection which eliminates all the disadvantages of the prior art and which is high in quality and reliability and is able to prevent any accidental electric shock and any impediment in electromagnetic waves and malfunction of a computer due to undesirable waves.

In order to accomplish said object in an interface cable connection including a male and a female connector at forward ends of two cables, each of the connectors having an insulator tightly fitted in a forward end of the connector, and contacts and an annular insulator embedded in the insulator, the connection according to the invention comprises a hood constructed of an insulating material and covering one of the connectors and the interface cable connected to the connector, and the hood includes filter means located adjacent to the connector.

When the hood having said filter means is mounted on an interface connector, the hood insulates and covers the connector.

Since the hood includes a filter, for example, a magnet, undesirable electromagnetic waves are filtered when the hood is fitted on an interface connector.

Since the hood has been previously manufactured so as to be detachable, terminal treatment of interface cables can be effected at job sites and molding treatment is not required at actual such sites after mounting of the connector.

The invention will be more fully understood by referring to the following detailed specification and claims taken in connection with the appended drawings.

DESCRIPTION OF THE PREFERRED EMBODIMENTS

Figure 1A:
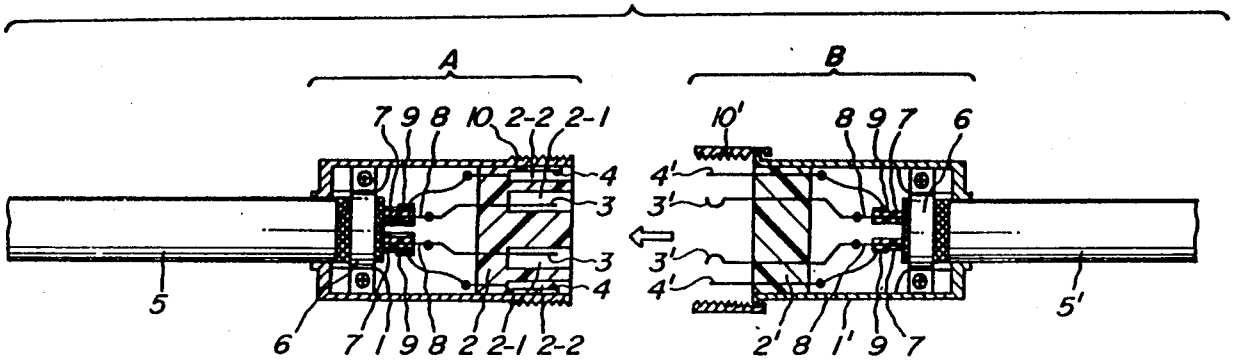
FIG. 1a PRIOR ART
FIGS. 1*a* and 1*b* and 2 illustrate interface cables with connectors of the prior art.
Figure 1B:
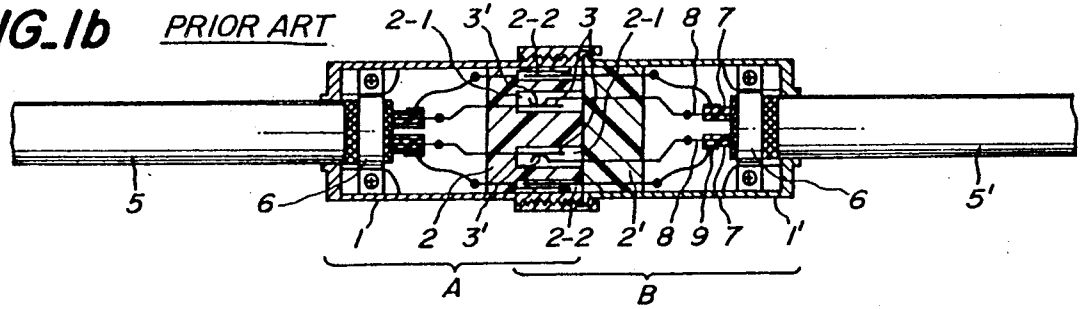
FIG. 1b PRIOR ART
Figure 2:
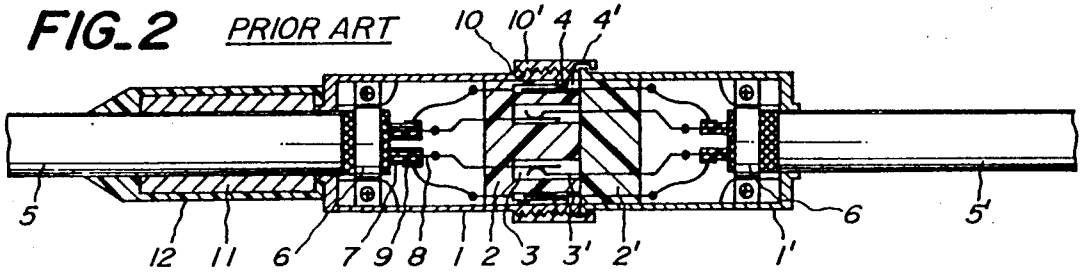
FIG. 2 PRIOR ART
Figure 3:
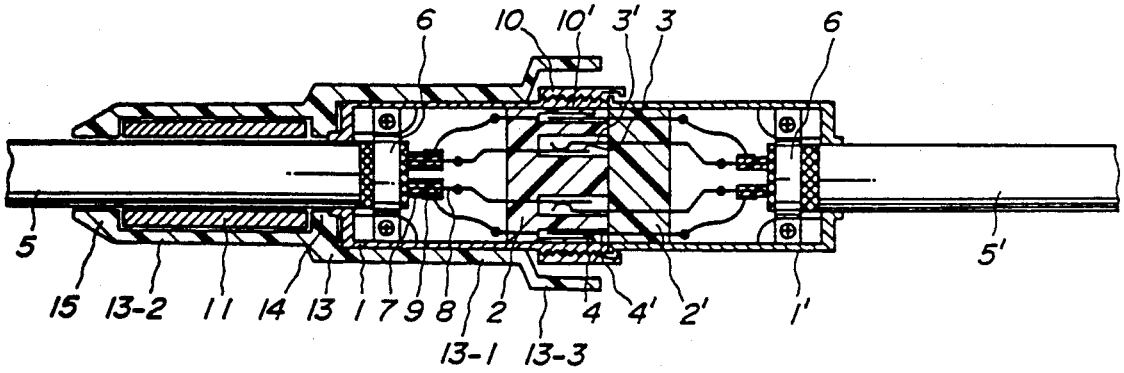
FIG. 3 illustrates an interface cable connection according to the invention.

FIG. 3 illustrates a connection of an interface cable according to the invention. In FIG. 3, like components are designated by the same reference numerals as those in FIG. 1. A metallic main body 1 or 1' receives therein an insulator 2 or 2' in which contacts 3 or 3' and an annular conductor 4 or 4', are retained. An interface cable 5 or 5' is clamped to a female or male connector and includes coaxial cables 7, each including a center conductor 8 and an outer conductor 9. Reference numeral 10 denotes screw threads formed on the main body 1 of the female connector, while reference numeral 10' denotes a connecting nut. The screw threads 10 and the connecting nut 10' form fastening means for firmly connecting the two connectors.

According to the invention there is provided a hood 13 including a filter 11, for example, a magnet built therein.

Figure 4:
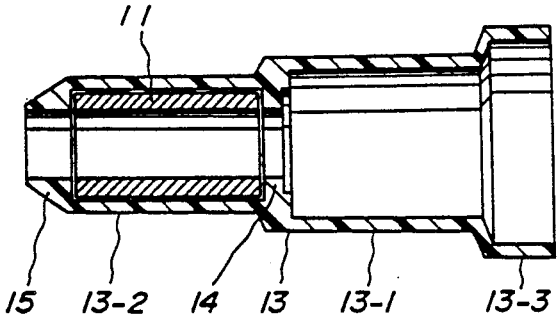
FIG. 4 illustrates a hood used in the interface cable connection according to the invention.

The hood having the magnet therein according to the invention is detachably mounted on a connector. A construction of the hood is shown in FIG. 4. In brief, the hood according to the invention comprises a connector covering portion 13-1 and a magnet enclosing portion 13-2 and, if required, an enlarged portion 13-3. The connector covering portion 13-1 receives therein the connector A or B. The magnet enclosing portion 13-2 encloses therein an annular or cylindrical magnet 11. The magnet used herein is annular or cylindrical and has an inner diameter slightly larger than a cable diameter and an outer diameter which is suitably selected but smaller than an outer diameter of the main body of the connector. The cylindrical magnet may be formed by a plurality of annular magnets which are equal or different in dimension or electromagnet characteristics.

In general, a commercially available magnet referred to as ferrite core is preferably used as the magnet 11. A material and magnetic force of the ferrite core may be properly selected depending upon kinds of waves to be filtered.

Sizes of the connector covering and magnet enclosing portions 13-1 and 13-2 can be selected relatively freely so long as they are able to accommodate the connector and the magnet, respectively. However, it is preferable to select sizes of the connector covering and magnet enclosing portions so as to be relatively small because of the somewhat restricted spaces in which such connectors usually are located.

If the hood 13 is made of an elastic material such as rubber, an inner diameter of the connector covering portion 13-1 may be slightly smaller than the outer diameter. With this arrangement, when once the hood is provided on the connector to cover it, the hood is firmly secured to the connector of its own accord with the aid of friction therebetween.

Moreover, a size of the enlarged portion 13-3 is suitably selected to be able to accommodate the connecting portion with a mating connector or the connecting nut and to permit the connecting operation. The enlarged portion 13-3 may be provided only on either one of the male and female connectors. A hood on the mating connector is not needed.

The hood 13 according to the invention is provided with an anchoring portion or reduced portion 14 between the connector covering portion 13-1 and the magnet enclosing portion 13-2 and an anchoring portion or reduced portion 15 at an end of the magnet enclosing portion 13-2. For example, inner diameters of the reduced portions 14 and 15 may be equal to or slightly smaller than an outer diameter of the interface cable 5 or 5'. In this manner, the hood 13 is fitted on the interface cable firmly to an extent such that the hood is not easily removed therefrom by reason of friction at least between the reduced portions 14 and 15 and the sheath of the interface cable 5 or 5'. The extent of the firm fitting may be suitably designed in a relation between materials of the hood 13 and the sheath of the interface cable 5 or 5'.

General examples of the material of the hood 13 are as follows. Where the sheath of the interface cable is made of a rubber or plastic material for general purpose, the hood according to the invention may be formed by a single or a mixed composition of a natural rubber, a synthetic rubber such as polybutadiene, polyisoprene, ethylene propylene rubber (EPR and EPTR), polyurethane, and the like, and a plastic such as non-rigid polyvinyl chloride, polyethylene and the like. Of these, the non-rigid polyvinyl chloride is most preferable.

The hood according to the invention can be made by general rubber or plastic forming techniques such as extruding, injection molding and the like. Injection molding is particularly effective for mass-production of the hoods.

In forming the connection of an interface cable according to the invention, first a terminal of the cable is treated. In the treatment of the terminal, a sheath of the interface cable is peeled over a predetermined length to expose coaxial cables. If there is a conductive braid, it is turned 180° on the sheath of the cable so as to cover the sheath. Moreover, insulating layers between center conductors 8 and outer conductors 9 of the exposed cable 5 or 5' are removed over a predetermined length, so that the center conductors 8 and outer conductors 9 are able to be connected to contacts 3 and 3' and annular conductors 4 and 4' of the connectors A and B to be connected. The terminal treatment is effected in this manner.

The previously manufactured hood 13 according to the invention has been previously fitted on the interface cable 5 whose terminal has been treated. Thereafter, the connector A or B is connected to the interface cable fitted with the hood 13. In more detail, the conductive braids of the interface cables 5 and 5' are fixed to the connectors A and B by means of the cable clamps, respectively, and center conductors 8 and the outer conductors 9 are connected to the contacts 3 and 3' and the annular conductors 4 and 4' of the connectors A and B. This connection is effected in one of various ways such as soldering, crimping, pressure joining, pressure welding and the like. Any one of the fixation of the cable and the connection of the conductors of the coaxial cables may be effected prior to the other. The order of the operations is not critical.

After the connectors A and B are secured to the interface cable 5 and 5' in the above manner, the connectors A and B are connected to each other so that the interface cables 5 and 5' are connected to each other through the inner conductors 8 and the outer conductors 9 of the respective cables. Thereafter, the hood 13 previously fitted on the cable 5 is moved toward the interface cable 5' so that the connector covering portion of the hood 13 completely covers the connector A. When the hood is stopped in position on the connector A, the hood is fixed on the cable so as not to move with ease with the aid of the resilience of the reduced portions 14 and 15 of the hood 13 and the frictional action between the cable sheath and the reduced portions. In the securement of the hood 13, an adhesive may be previously applied to the reduced portions 14 and 15 so that a more reliable securement is accomplished.

Figure 5:
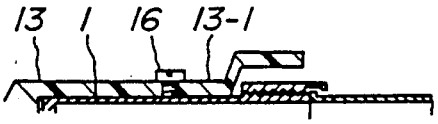
FIG. 5 is a partial sectional view illustrating a preferred embodiment of the invention.

In the securement, moreover, any known means may be used, for example, clamping, stud screws and the like. For example, as shown in FIG. 5, the connector covering portion 13-1 of the hood 13 is formed with a small screw-threaded aperture passing therethrough, and a set screw 16 is threadedly engaged in the screwed aperture so that the metal main body 1 is urged by an inner end of the set screw 16.

Although the hood 13 has been explained only with respect to one of the male and female connectors in the above description, two hoods 13 may be provided at both the connectors, respectively. In such case, the enlarged portion 13-3 may be provided only at one of the two hoods. It is not necessary to provided the hood at each of the two hoods.

Moreover, in case one of the male and female connectors provided with the connecting nut 1 does not have the hood 13, the connecting nut 1 may be coated on its outer circumference with a coating layer of an insulating rubber or plastic material. With such an arrangement, an operator can effect the connecting and disconnecting of the connectors A and B without touching the electrically conductive portions. Therefore, the operator is protected from accidental electric shock due to unpredictable charging which is one problem in the prior art intended to be avoided.

Although the connection between cables at the midpoint of an interface cable connecting between electronic appliances has been explained, the invention is not limited to such a connection. The present invention is applicable to a connector on a side of an interface cable at a connection between the interface cable and a receptacle connector attached to an electronic appliance.

Moreover, in the above embodiment the hood 13 is fixed only with the aid of the resilience and friction of the reduced portions 14 and 15. A clamping fastener applied to an outer circumference of the hood or serrations formed in an inner circumference of the hood and an outer circumference of the cable or connector may be used which is a change of design within the scope of the invention.

Furthermore, the male and female shapes of contacts embedded in the insulators at the connection according to the invention are not necessarily corresponding to the male and female shapes of connectors (insulators) to be fitted. Any combination of them may be selected as the case may be. For example, a contact is formed in a female type, while a connector (insulator) receiving the contact may be a female or male type.

Although the invention has been explained with respect to coaxial multicore interface cables, the invention is of course applicable to other general interface cables.

The invention as above described can bring about the following particularly significant effects.

(1) The connection of the interface cable according to the invention includes an insulating hood covering a metallic connector. Therefore, even if an extraordinary electric voltage is applied to the interface cable, any accidental electric shock can be avoided.

(2) The connection of the interface cable according to the invention includes a hood having a magnet around the interface cable adjacent connector so that undesirable electromagnetic waves are filtered to prevent any impediment in electromagnetic waves, malfunction of a computer and the like due to the undesirable waves.

(3) The hood used in the connection according to the invention can be manufactured in a well-equipped factory. Consequently, hoods of a constant quality and requisite numbers can be produced at pre-planned quantities.

(4) The hood according to the invention is preformed and detachably attached to the connector. In forming the connection of an interface cable, therefore, the hood does not require mold working requiring particular equipment, tools and treatment. Consequently, the invention can provide a connection which is high in quality and reliability, particularly in a connecting operation which requires specific lengths of interface cables at actual locations.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An interface cable connection comprising, a male and a female connector at forward ends of two interface cables, each of the connectors having an insulator tightly fitted in a forward end of the respective connector, and contacts embedded in the respective insulator, an annular conductor embedded in one of the insulators, and a hood made of an insulating material, said hood being separable from and covering one of the connectors and the interface cable connected to the connector, the hood having filter means provided therein, adjacent to but outside of the connector.

2. An interface cable connection as set forth in claim 1, wherein said cable connection comprises fastening means having male screw threads and female screw threads, said male screw threads being formed in a metallic main body of the connector provided with the hood, and said female screw threads having an outer circumference provided with an insulating coating.

3. An interface cable connection as set forth in claim 1, wherein said hood comprises a connector covering portion for covering the connector and a magnet enclosing portion for enclosing said filter means, and anchoring means provided between the connector covering portion and the magnet enclosing portion at an end of the magnet enclosing portion.

4. An interface cable connection as set forth in claim 3, wherein said anchoring means is an inner diameter reduced portion whose inner diameter is at least equal to an outer diameter of the interface cable.

5. An interface cable connection as set forth in claim 4, wherein said anchoring means is fixed to the interface cable with an adhesive.

6. An interface cable connection as set forth in claim 1, wherein said hood is formed of an elastic material and has a connector covering portion for covering the connector, the inner diameter of said connector covering portion being slightly smaller than the outer diameter of a metallic main body of the connector.

7. An interface cable connection as set forth in claim 1, wherein said hood is made of non-rigid polyvinyl chloride.

8. An interface cable connection as set forth in claim 1, wherein said filter means is a cylindrical magnet having a center aperture through which the interface cable passes.

9. An interface cable connection as set forth in claim 8, wherein said magnet is a ferrite core.

10. An interface cable connection as set forth in claim 1, wherein said hood comprises a connector covering portion for covering one connector and an enlarged portion at a forward end of the connector covering portion for receiving fastening means for fastening the connector with the other connector.

11. An interface cable connection as set forth in claim 1, wherein said hood has a connector covering portion for covering the connector, said connector covering portion being formed with a screw-threaded aperture and a set screw threadly engaged in the screw-threaded aperture of the connector covering portion and having an inner end being urged against a metallic main body of the connector, thereby fixing the hood against the connector.

* * * * *